US008520035B2

(12) United States Patent
Lee et al.

(10) Patent No.: US 8,520,035 B2
(45) Date of Patent: Aug. 27, 2013

(54) METHOD OF DRIVING COLUMN INVERSION DISPLAY PANEL AND DISPLAY APPARATUS FOR PERFORMING THE SAME

(75) Inventors: Hyoung-Rae Lee, Asan-si (KR); Seong-Il Kim, Asan-si (KR); Seung-Woon Shin, Asan-si (KR); Jung-Hoon Ku, Cheonan-si (KR); Choong-Hwa Kim, Seongnam-si (KR)

(73) Assignee: Samsung Display Co., Ltd. (KR)

( * ) Notice: Subject to any disclaimer, the term of this patent is extended or adjusted under 35 U.S.C. 154(b) by 297 days.

(21) Appl. No.: 12/962,452

(22) Filed: Dec. 7, 2010

(65) Prior Publication Data

US 2011/0242140 A1 Oct. 6, 2011

(30) Foreign Application Priority Data

Apr. 6, 2010 (KR) ..... 10-2010-0031166

(51) Int. Cl.
*G09G 5/10* (2006.01)
*G09G 3/36* (2006.01)

(52) U.S. Cl.
USPC ..... 345/690; 345/89

(58) Field of Classification Search
None
See application file for complete search history.

(56) References Cited

U.S. PATENT DOCUMENTS

| | | | | |
|---|---|---|---|---|
| 7,375,707 | B1 * | 5/2008 | Lee | 345/89 |
| 2005/0195671 | A1 * | 9/2005 | Taguchi | 365/203 |
| 2006/0170631 | A1 * | 8/2006 | Togashi et al. | 345/82 |
| 2007/0091044 | A1 * | 4/2007 | Park et al. | 345/88 |
| 2008/0024418 | A1 * | 1/2008 | Kim | 345/98 |

FOREIGN PATENT DOCUMENTS

| | | | |
|---|---|---|---|
| JP | 2003-330431 | A | 11/2003 |
| JP | 2006-039542 | A | 2/2006 |
| KR | 1020050053804 | A | 6/2005 |
| KR | 1020070063944 | A | 6/2007 |
| KR | 1020080062934 | A | 7/2008 |
| KR | 1020080097307 | A | 11/2008 |
| KR | 1020090022471 | A | 3/2009 |

* cited by examiner

*Primary Examiner* — Alexander S Beck
*Assistant Examiner* — Ibrahim Khan
(74) *Attorney, Agent, or Firm* — Innovation Counsel LLP

(57) ABSTRACT

In a method of driving a display panel, a gate signal is outputted to the display panel based on a first control signal. A gamma-corrected analog voltage is generated. A pre-charge compensating analog voltage is generated. A data voltage waveform is generated to include the generated gamma-corrected analog voltage and the generated pre-charge compensating analog voltage during one horizontal period of the display panel. The display panel has a pixel structure in which a data line is alternately connected to first and second subpixel columns adjacent to each other. The pre-charge compensating voltage has a level different from that of the gamma-corrected analog voltage where the latter represents a grayscale level represented by a received digital data signal. According to the method, display defects due to a difference of pre-charging levels used during plural horizontal periods may be decreased so that display quality of the display panel may be improved.

16 Claims, 8 Drawing Sheets

METHOD OF DRIVING COLUMN INVERSION DISPLAY PANEL AND DISPLAY APPARATUS FOR PERFORMING THE SAME

PRIORITY STATEMENT

This application claims priority under 35 U.S.C. §119 to Korean Patent Application No. 2010-31166, filed on Apr. 6, 2010 in the Korean Intellectual Property Office (KIPO), the contents of which application are herein incorporated by reference in their entirety.

BACKGROUND

1. Field of Disclosure

The present disclosure of invention relates to a method of driving a display panel and a display apparatus structured for performing the method. More specifically, the disclosure relates to pre-charging of an LCD panel operating with a column inversion structure.

2. Description of Related Technology

Generally, a liquid crystal display (LCD) apparatus includes a first substrate including pixel or subpixel units each having a respective, to-be-charged pixel electrode, a second substrate including a common electrode and a liquid crystal layer disposed between the first and second substrates. An electric field is generated by voltages developed between the to-be-charged pixel electrode and its counterfacing portion of the common electrode. By adjusting an intensity of the electric field, transmittance of light passing through the liquid crystal layer may be adjusted so that a desired image may be formed and displayed.

If an electric field having a constantly same direction or polarity is continuously applied to the liquid crystal layer, a desired characteristic of a liquid crystal may be degraded. In order to prevent the degradation of the characteristic of the liquid crystal, an inversion driving method is used which repeatedly inverts a phase of a data voltage applied across the liquid crystal where the phase is with respect to a common voltage applied to the common electrode. One of various inversion driving methods is a dot inversion method (DIM) in which data drive phases of adjacent subpixels or dots across the entire display frame are alternated and reversed repeatedly such as in each successive display frame. This legacy DIM approach creates a checkerboard pattern of plus (+) and minus (−) polarities in each frame as across the matrix of subpixels provided on the display area.

When employing the DIM, the degradation of the characteristic of the liquid crystal may be prevented or reduced, however, the process of providing the inverted or not inverted data voltages to respective individual pixels may be complicated. Additionally, signals on the data lines may be delayed as a result, and power consumption of the LCD apparatus may be disadvantageously increased. In order to solve the above-mentioned problems, a data column inversion method has been proposed in which image data voltages having polarities different from each other are applied to adjacent data lines of the display substrate. When employing the column inversion method, the polarity of data voltage applied to each respective data line is inverted in each successive frame so that the applying process of the data voltage may be simplified, and the delay time of the signals on the data lines may be decreased. To obtain the DIM checkerboard effect while instead using the column inversion method, subpixels in a single column are alternately connected to one of two data lines adjacent to the column of subpixels where one data line is driven under a first polarity at the time (e.g., positive (+)) and the other data line is driven under an opposed second polarity at the time (e.g., negative (−)). Accordingly, the checkerboard pattern of positives (+) and negatives (−) may be obtained even though each data line is being driven under just one polarity scheme in the given frame.

In addition, in recent times it has become desirable to provide high resolution in the LCD apparatus so that an image having high display quality may be displayed. As the resolution of the LCD is increased, time to charge each subpixel tends to become shortened.

To compensate for the shortened charging time, a pre-charge driving method is generally used. In the precharge driving method, a precharge voltage that is assumed to be approximating the magnitude which next is to be applied to the pixel electrode is pre-charged onto the pixel electrode. Thus, although the charging time is shortened in high resolution LCD devices, the desired final data voltage may be sufficiently charged onto the pixel electrode if that electrode has been appropriately pre-charged to a magnitude close to the final one.

However, when a conventional precharge driving method is used in combination with certain variations of the DIM-checkerboard mimicking, column inversion method, the appropriate precharging voltage is sufficiently charged only onto some pixel electrodes but not onto other pixel electrodes (where precharging is based on a previous data voltage applied to nearby pixel electrodes). Because some pixels receive an appropriate pre-charge and some do not, a difference of effective pre-charging relative to desired luminance can develop as between two adjacent rows of pixels. Accordingly, a difference of actual luminance between two adjacent rows of pixels (as opposed to desired luminances) may be undesirably created due to the difference of effective or ineffective pre-chargings applied to those adjacent rows. Thus, a horizontal dark or bright streak line may appear to be displayed on a display panel as an undesirable artifact resulting from the pre-charging process so that displayed image appears to have defects.

SUMMARY

In an example method of driving a display panel according to the present disclosure, the display panel has gate lines and data lines and the display panel is structured for polarity inversion by way of column inversion applied to the data lines. The method comprises the machine-implemented steps of (a) outputting a row-selecting gate signal that is active over a plurality of horizontal scan periods to one of the gate lines of the display panel; (b) generating a gamma-corrected analog voltage corresponding to a received digital data signal, where the data signal represents a desired luminance output of a subpixel of the display; (c) generating a pre-charge compensating signal; and (d) outputting to a corresponding one of the data lines, an analog data voltage waveform having a grayscale voltage level portion corresponding to the gamma-corrected analog voltage and having a compensating voltage signal portion corresponding to the pre-charge compensating signal, where the compensating voltage signal portion has a magnitude different from that of the grayscale voltage level portion, where the gamma-correcting voltage level pixel and the compensating voltage signal portion appear during one horizontal scan period, and where the display panel has a multi-pixels structure in which each data line is alternately connected when traversing along the data line, to first and second subpixel columns disposed substantially adjacent to each other.

In one embodiment, the display panel comprises a plurality of repeated pixel units, where a first of the pixel units is an RGB pixel unit and it comprises: a first subpixel (R1) connected to a first gate line ($GL_q$) and a first data line ($DL_p$); a second subpixel (G1) connected to the first gate line and a second data line ($DL_{p+1}$) adjacent to the first data line; a third subpixel (B1) connected to the first gate line and a third data line ($DL_{p+2}$) adjacent to the second data line; where a second of the pixel units is disposed immediately below the first pixel unit and it comprises: a fourth subpixel (R2) connected to a second gate line (GLq+1) and a fourth data line ($DL_{p-1}$); a fifth subpixel (G2) connected to the second gate line and the first data line; a sixth subpixel (B2) connected to the second gate line and the second data line; where a third of the pixel units is disposed immediately below the second pixel unit and it comprises: a seventh subpixel (R3) connected to a third gate line (GLq+2) and the first data line; an eight subpixel (G3) connected to the third gate line and the second data line; a ninth subpixel (B3) connected to the third gate line and the third data line; and wherein the eight subpixel (G3) is pre-charged with a final charging voltage of the second subpixel (G1) and with a final charging voltage of the fifth subpixel (G2).

The gamma-correcting voltage may have at least two levels corresponding to one data signal during one horizontal period.

The gamma-correcting voltage waveform may include a reference gamma-correcting voltage level corresponding to a grayscale value represented by a received digital data signal where the gamma-correcting voltage level is output during a first interval of one horizontal period and a pre-charge compensating voltage level different from the reference gamma-correcting voltage level and output during a second interval of one horizontal period.

The second interval may be prior to the first interval in one horizontal period.

The second interval may be shorter than the first interval.

By using a composite waveform during each horizontal period, where the composite waveform has the gamma-correcting voltage level and the pre-charge compensating voltage level, a difference of pre-charging amounts between two pixels adjacent to each other may be compensated for so that a horizontal streak line due to a luminance difference may be prevented. Therefore, display quality of a display panel may be improved.

BRIEF DESCRIPTION OF THE DRAWINGS

The above and other features and advantages of the present disclosure of invention will become more apparent by describing in detailed example embodiments in accordance with the disclosure with reference to the accompanying drawings, in which.

DETAILED DESCRIPTION

Figure 1:
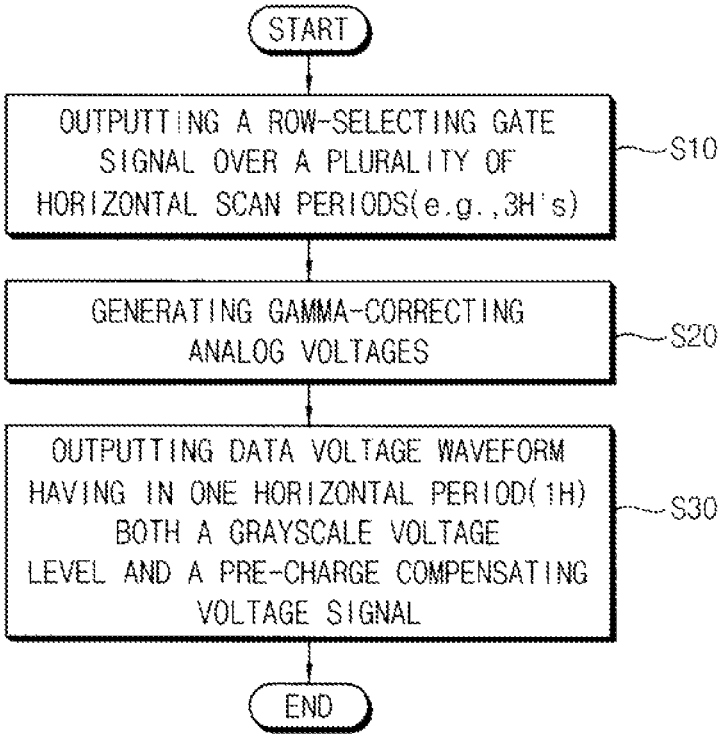
FIG. 1 is a flowchart illustrating a method of driving a display panel according to an example embodiment.

The present disclosure of invention is provided more fully hereinafter with reference to the accompanying drawings, in which example embodiments are shown. The present teachings may, however, be embodied in many different forms and should not be construed as limited to the example embodiments set forth herein. Rather, these example embodiments are provided so that this disclosure will be thorough and complete, and will fully convey the scope of the present teachings to those skilled in the pertinent art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the present teachings.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present teachings. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments in accordance with the disclosure are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present teachings.

Unless otherwise defined, all terms (including technical and scientific terms) used herein have the same meaning as commonly understood by one of ordinary skill in the art to which this disclosure of invention most closely pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiment in accordance with the present teachings will be explained in detail with reference to the accompanying drawings.

Figure 2:
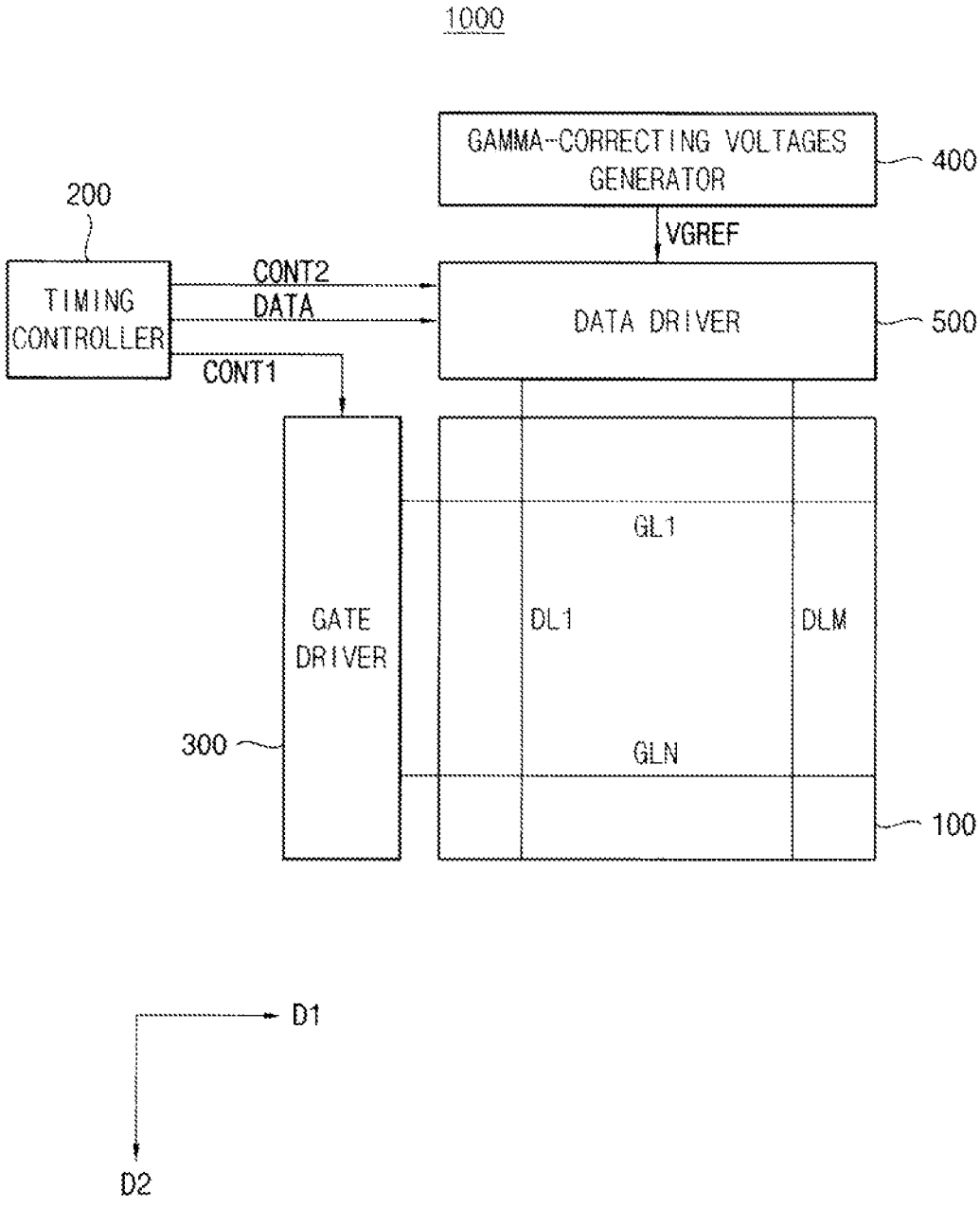
FIG. 2 is a block diagram illustrating a display apparatus that can be structured to perform the method of FIG. 1.

FIG. 1 is a process flow chart or timing diagram illustrating a method of driving a display panel in accordance with an example embodiment of the present teachings. FIG. 2 is a block diagram illustrating a display apparatus structured to perform the method of FIG. 1.

Referring to FIGS. 1 and 2, the display apparatus 1000 includes a display panel 100, a timing controller 200, a gate driver 300, a gamma-correcting voltages generator 400 and a data driver 500. In the method of driving the display panel 100, the gate driver 300 outputs a gate signal to the display panel 100 based on a first control signal CONT1 (step S10). The gamma-correcting voltages generator 400 generates a plurality of gamma-correcting voltages or voltage waveforms VGREF (step S20) each corresponding to a discrete brightness level and to a predetermined gamma-function associated therewith. The data driver 500 outputs an analog data voltage signals to the display panel 100 based on a supplied second control signal CONT2, on a supplied data signal DATA and on the gamma-correcting voltages or voltage waveforms VGREF generated by the voltages generator 400 (step S30). The output analog data voltage signal includes a gamma-corrected grayscale voltage component corresponding to the supplied digital data signal DATA and a pre-charge compensating voltage component having a magnitude that is generally different from that of the gamma-corrected grayscale voltage component. The display panel 100 includes a pixel structure in which each data line is alternately connected, when traveling longitudinally along the data line, to first and second subpixel columns adjacent to the data line.

Figure 3:
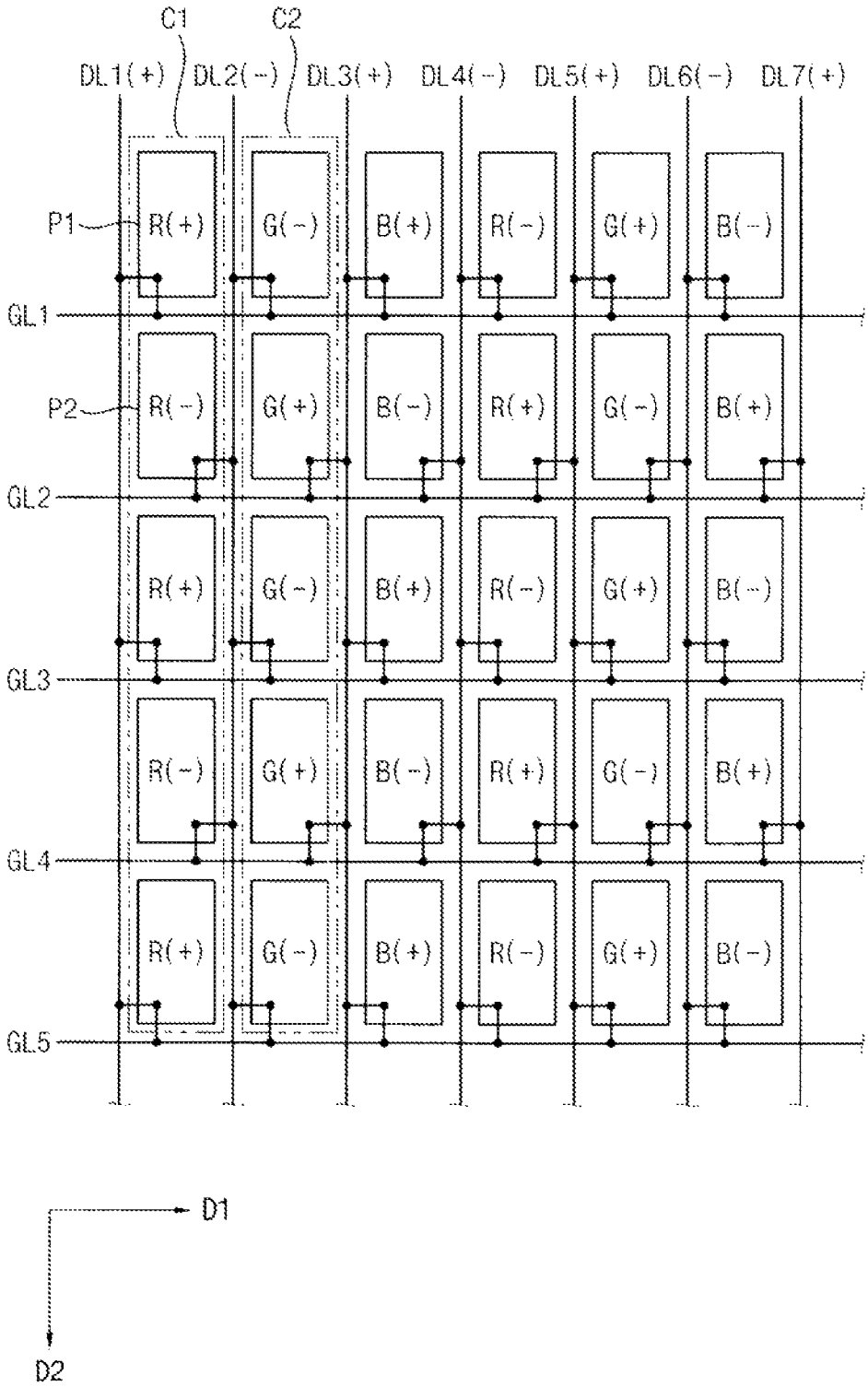
FIG. 3 is a plan view illustrating a pixel array of a display panel of FIG. 2.

FIG. 3 is a plan view illustrating pixel structures in a display area of the display panel of FIG. 2.

Referring to FIGS. 2 and 3, the display panel 100 includes a plurality of gate lines GL1 to GLN, a plurality of data lines DL1 to DLM and a plurality of pixel units P each having a plurality of differently colored subpixels (e.g., Red, Green and Blue subpixels). The gate lines GL1 to GLN are extended in a first direction D1, and the data lines DL1 to DLM are extended in a second direction D2 crossing the first direction D1. Each of the subpixels has a respective subpixel driving or addressing element TR (e.g., a thin film MOSFET), and a liquid crystal capacitor and a storage capacitor electrically connected to the driving element TR. The subpixels define a plurality of subpixel columns (e.g., C1, C2, etc.) arranged to extend in the second direction D2. The subpixels that are found when traveling longitudinally down each subpixel column are seen to be alternately connected to two data lines adjacent to that subpixel column.

For example, a first subpixel column C1 in FIG. 3 is disposed between a first data line DL1 and a second data line DL2 (where for the instant image frame, DL1 is being driven with positive (+) polarity data signals and DL2 is being driven with negative (−) polarity data signals). A second subpixel column C2 adjacent to the first subpixel column C1 is seen to be disposed between the second data line DL2 and a third data line DL3 (where for the instant image frame, DL3 is being driven with positive (+) polarity data signals). The successive subpixels in the first subpixel column C1 are alternately connected to the first and second data lines DL1 and DL2, while the successive subpixels in the second subpixel column C2 are alternately connected to the second and third data lines DL2 and DL3. Data voltages having opposite polarities are respectively applied to respective pairs of adjacent data lines. More specifically, when a luminance-defining first data voltage having a positive polarity (+) is applied to the first data line DL1, a luminance-defining second data voltage having a negative polarity (−), in other words, inverted with respect to Vcom and thus opposed to the positive polarity (+) of the first data signal is applied to the second data line DL2. A data voltage having the positive polarity (+) is applied to the third data line DL3. Accordingly, the inverted data voltages having the polarities of +, −, +, −, +, . . . are respectively applied to the successive subpixels found in the first subpixel column C1, and the inverted data voltages having the polarities of −, +, −, +, −, . . . are respectively applied to the successive subpixels found in the second subpixel column C2. The first subpixel column C1 includes a first subpixel P1 connected to a first gate line GL1 and the first data line DL1, and a second subpixel P2 connected to a second gate line GL2 and the second data line DL2. As a result, the display panel 100 may have a dot inversion effect, that is, each pixel is inverted in the first direction D1 and the second direction D2 even though a column inversion method is being used.

In addition, in a next frame, data voltages having the negative polarity (−) will be applied to the first data line DL1, while data voltage having the positive polarity (+) will be applied to the second data line DL2, and further data voltages having the negative polarity (−) will be applied to the third data line DL3. Accordingly, in the next frame, the inverted data voltages having the polarities of −, +, −, +, −, . . . are respectively applied to the pixels in the first subpixel column C1, and the inverted data voltages having the polarities of +, −, +, −, +, . . . are respectively applied to the pixels in the second subpixel column C2. Thus, the inverted data voltages in each frame are applied to each subpixel P of the display panel 100.

Referring to FIGS. 1 to 3, the timing controller 200 generates the first control signal CONT1, the second control signal CONT2 and the digital data signal DATA. The timing controller 200 generates the first control signal CONT1 controlling a driving timing of the gate driver 300 based on a control signal from outside and outputs the first control signal CONT1 to the gate driver 300. The timing controller 200 generates the second control signal CONT2 controlling a driving timing of the data driver 500 and outputs the second control signal CONT2 to the data driver 500. The timing controller 200 converts an input digital image signal supplied from outside to a device-compatible digital data signal DATA to thereby satisfy operating requirements of the display panel 100, and outputs the device-compatible digital data signal DATA to the data driver 500.

The first control signal CONT1 may include a vertical synchronizing signal, a gate clock signal, and first, second and third ON signals. The second control signal CONT2 may include a horizontal synchronizing signal HSYNC, a load signal, an inverting signal and a data clock signal.

The gate driver 300 generates gate signals to drive the gate lines GL1 to GLN in response to the first control signal CONT1 provided from the timing controller 200. The gate driver 300 sequentially outputs the gate signals to the gate lines GL1 to GLN (step S10) so that each row is addressed in sequence (for pre-charging and final charging purposes) and so that corresponding final analog data signals can be charged onto pixel-electrodes of the addressed row of pixels at their respective, final charging times.

The gate driver 300 may be directly integrated on the display panel 100. For example, the gate driver 300 may include a plurality of thin-film transistors (TFTs) formed by the same process as forming the TFTs of the pixels of the display panel 100. For example, the gate driver 300 may be directly integrated on the display panel 100 using amorphous silicon TFT (ASG type). In this case, a separately packaged and additional gate driving integrated circuit (IC) is not required so that a manufacturing process may be simplified. Alternatively, the gate driver 300 may be mounted as a separate IC on the display panel 100 using a chip type mounting method or a tape carrier package (TCP) type mounting method.

The gamma-correcting voltages generator 400 generates the gamma-correcting voltages VGREF (step S20). The gamma-correcting voltages generator 400 provides the gamma-corrected analog voltages VGREF to the data driver 500. The gamma-corrected voltages VGREF have respective gamma-corrected analog magnitudes corresponding to each discrete digital value representable by the data signals DATA. For example, the gamma-correcting voltages generator 400 may include a resistor string circuit. The resistor string circuit has a plurality of resistors connected to each other in series, and these are sized to divide a reference source voltage (measured relative to a ground voltage) into the plurality of gamma-corrected voltage levels (included in VGREF waveforms described below) for output to the data driver 500.

The data driver 500 receives the second control signal CONT2 and the data signal DATA from the timing controller 200 and receives the gamma-corrected voltages VGREF from the gamma-correcting voltages generator. The data driver 500 converts each received data signal DATA to a corresponding analog data voltage using the gamma-corrected voltages VGREF to thereby output the corresponding analog data voltages to the data lines DL1 to DLM (step S30).

Figure 4:
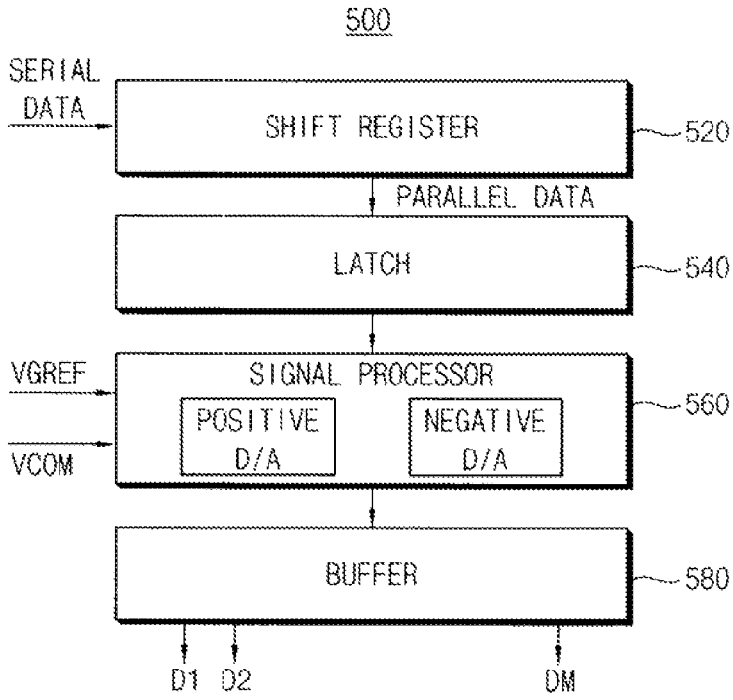
FIG. 4 is a detailed block diagram illustrating a data driver of FIG. 2.

FIG. 4 is a detailed block diagram illustrating a data driver of FIG. 2.

Referring to FIGS. 2 to 4, the data driver 500 includes a shift register 520, a latch 540, a signal processor 560 and a buffer 580.

The shift register 520 receives input DATA in serial format and outputs the received serial DATA as parallel output DATA for latching into latch 540 when a latch pulse is applied to the latch 540.

The latch 540 temporarily stores the parallel data signals DATA and outputs the latched data signals DATA to signal processor 560.

The signal processor 560 converts the latched digital data signals DATA to their gamma-corrected analog counterpart data voltage magnitudes (or waveforms as shall be detailed below) based on the received digital data signal DATA and the received gamma-correcting voltage signals VGREF. The signal processor 560 then outputs polarity appropriate versions of the analog data voltages. In one embodiment, the signal processor 560 includes first and second digital-to-analog converters (D/A converters, not shown). The first digital-analog converter converts each received data signal DATA to a corresponding data voltage having the first polarity (e.g., positive (+) polarity) and outputs the data voltage with that polarity. The second digital-analog converter converts each received data signal DATA to a corresponding data voltage having the second polarity (e.g., negative (−) polarity) and outputs its data voltage with that opposed polarity. Buffer 580 may be operated to electronically elect to use either polarity.

In accordance with one variation of the present disclosure, the buffer 580 may include compensating means for adding a compensation factor to each of the processor output signals to thus compensate the data voltages outputted from the signal processor 560 so as to provide uniform luminance irrespective of the chosen polarity. However, in accordance with a second variation the present disclosure, the compensation factor is built-in to the gamma-correcting voltage signals VGREF output by the gamma-correcting voltages generator 400.

Figure 5:
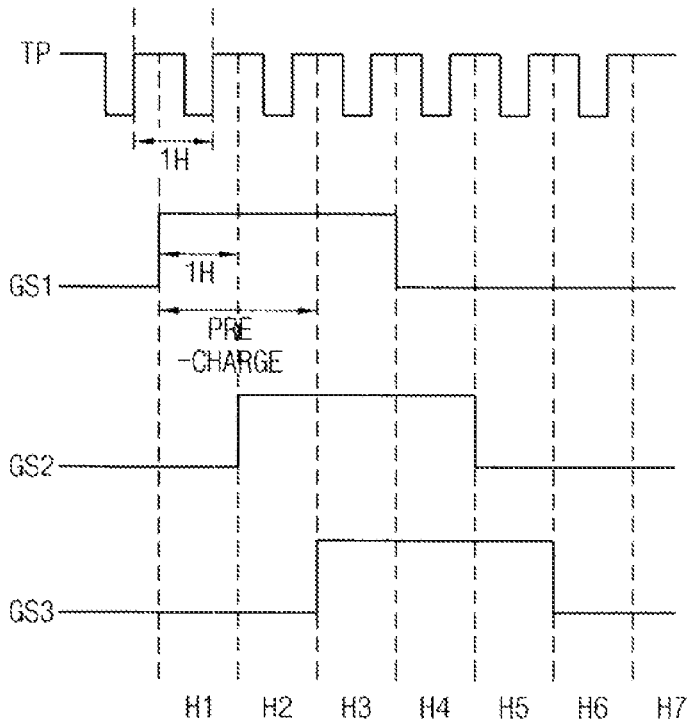
FIG. 5 is a timing diagram illustrating a three-line precharging driving method.

FIG. 5 is a timing diagram illustrating a three-line precharging method.

Referring to FIGS. 2 and 5, the timing controller 200 outputs a load synchronizing signal TP to the data driver 500. The load signal TP controls an output of the data voltages for each pixel of the data driver 500. A period from a rising edge of a first load signal to a rising edge of a second load signal is defined as one horizontal period 1H. The image defining voltage that is left behind on each pixel-electrode at the end of a gate selecting process (e.g., GS1 being high) is generally defined by the last data line voltage present as the gate selecting signal (e.g., GS1) goes low. That level is substantially retained for the remainder of the duration of an image frame (where a frame has many 1H periods, e.g. one final charging one for each pixel row).

The display panel 100 according to the present example embodiment is driven in accordance with the three-line precharging method wherein, the gate selecting signal (GSi) is continuously held high or in the ON state for three successive horizontal periods 3H to thereby increase the amount of time available for precharging and then finally charging each subpixel. For example, a first gate signal GS1 is held HIGH during a first three horizontal periods 3H, from a first horizontal period denoted as H1 to a third horizontal period denoted as H3. Overlapping with this, a second gate signal GS2 is held HIGH during three horizontal periods 3H, from a second horizontal period denoted as H2 to a fourth horizontal period denoted as H4. Overlapping with this, a third gate signal GS3 is held HIGH during three horizontal periods 3H, from the third horizontal period denoted as H3 to a fifth horizontal period denoted as H5.

For example, during the first and second horizontal periods (H1-H2) of the three horizontal periods 3H denoted as H1-H3, data voltages corresponding to pixels of two previous rows are applied and thus precharged onto a pixel electrode connected to the gate line (GLi) to which the first gate signal GS1 is applied. During the third horizontal period (H3) of three horizontal periods 3H, the to-be-retained final data voltage corresponding to the present pixel luminance is applied to the pixel electrode connected to the given gate line (GLi). Similarly, during the second and third horizontal periods (H2-H3) of three horizontal periods 3H, data voltages corresponding to the previous pixels are applied and precharged to a pixel connected to a second gate line (GLi+1) to which the second gate signal GS2 is applied. During the fourth horizontal period (H4) of three horizontal periods 3H, a final data voltage corresponding to the present pixel is applied to the pixel connected to the second gate line. Similarly, during the third and fourth horizontal periods (H3-H4) of three horizontal periods 3H, data voltages corresponding to the previous pixels are applied and precharged to a pixel connected to the third gate line (GLi+2) to which the third gate signal GS3 is applied. During the fifth horizontal period (H5) of three horizontal periods 3H, a final data voltage corresponding to the present pixel is applied to the pixel connected to the third gate line (GLi+2).

Figure 6:
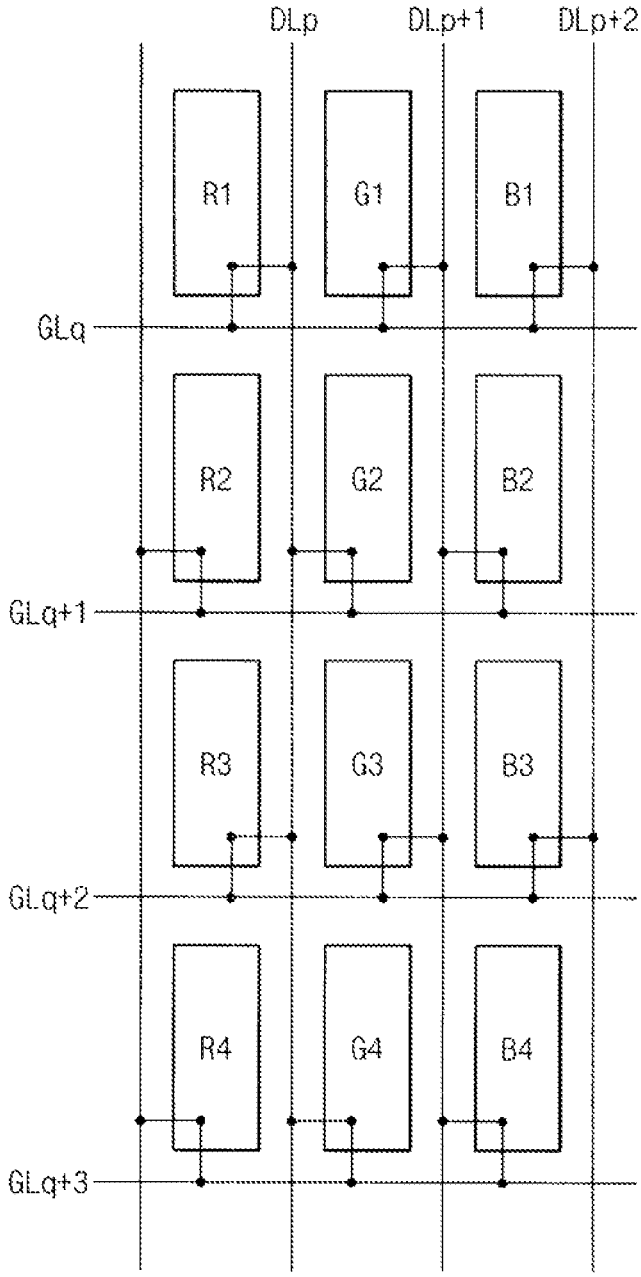
FIG. 6 is a plan view illustrating an enlarged portion of the display panel of FIG. 3 to explain the three-line precharging driving method in more detail.

FIG. 6 is a plan view illustrating a portion of the display panel of FIG. 2 in greater detail to further explain the three-line precharging method.

Referring to FIGS. 5 and 6, the illustrated portion of the display panel 100 includes first to fourth red subpixels R1, R2, R3 and R4, first to fourth green subpixels G1, G2, G3 and G4, first to fourth blue subpixels B1, B2, B3 and B4, a (q)th gate line GLq, a (q+1)th gate line GLq+1, a (q+2)th gate line GLq+2, a (q+3)th gate line GLq+3, a (p)th data line DLp and a (p+1)th data line DLp+1.

For example, the (p)th data line DLp is alternately connected to the first red subpixel R1, the second green subpixel G2, the third red subpixel R3 and the fourth green subpixel G4 to output respective but same polarity data voltages to each subpixel for precharging and finally charging those subpixels in their respective turns. Similarly, the (p+1)th data line DLp+1 is alternately connected to the first green subpixel G1, the second blue subpixel B2, the third green subpixel G3 and the fourth blue subpixel B4 to output the data voltage for each pixel.

As discussed above, the display panel 100 according to the present example embodiment is driven in the three-line precharging method so that, for example, the (q+2)th gate line GLq+2 is held ON during three horizontal periods 3H of each frame. For example, as for the third red subpixel R3, during the first horizontal period of three horizontal periods 3H, the final data voltage for the first red pixel R1 is precharged onto the third red pixel R3. During the second horizontal period of three horizontal periods 3H, the final data voltage for the second green subpixel G2 is precharged onto the third red subpixel R3. During the third horizontal period of three horizontal periods 3H, the final data voltage for the third red subpixel R3 is outputted to the third red subpixel R3. For example, as for the third green subpixel G3, during the first horizontal period of three horizontal periods 3H, the final data voltage for the first green subpixel G1 is precharged onto the pixel-electrode of the third green subpixel G3. During the second horizontal period of three horizontal periods 3H, the final data voltage for the second blue subpixel B2 is precharged onto the pixel-electrode of the third green subpixel G3. During the third horizontal period of three horizontal periods 3H, the final data voltage for the third green subpixel G3 is outputted to the third green subpixel G3.

Figure 7:
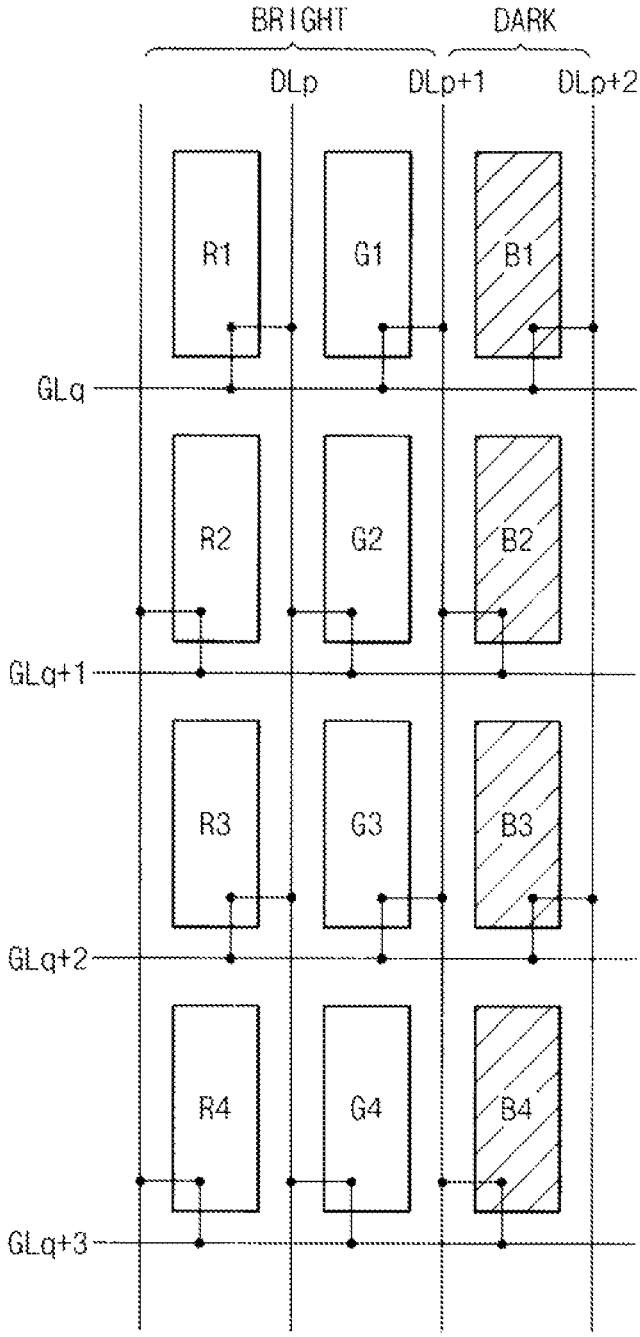
FIG. 7 is a plan view illustrating the portion of the display panel of FIG. 6 wherein two columns are driven to relatively bright grayscale levels and one to a relatively dark grayscale level where this state can lead to producing an undesired line streaking effect under the three-line precharging driving method.

FIG. 7 is a plan view illustrating the portion of the display panel of FIG. 2 to explain a display defect that may occur due to conventional operation of the three-line precharging method.

Referring to FIGS. 5 to 7, assume the data voltages for the first to fourth red pixels R1, R2, R3 and R4 and the first to fourth green pixels G1, G2, G3 and G4 correspond to high grayscale luminance values (and thus the corresponding final data voltages are high or bright grayscale voltages). In contrast, assume the data voltages for the first to fourth blue pixels B1, B2, B3 and B4 are low grayscale voltages (so as to leave those Blue subpixels relatively dark). After pre-charging and final charging, the first to fourth red pixels R1, R2, R3 and R4 and the first to fourth green pixels G1, G2, G3 and G4 may display the maximum luminance values corresponding to the maximum grayscale voltages applied to them such as bright white voltages. Similarly, the first to fourth blue pixels B1, B2, B3 and B4 may display as dark or black corresponding to the minimum grayscale voltage such as the dark black voltages or the common voltage applied to them at the ends of their pre-charging and final charging sequences.

However, in the case of the pre-charging and final charging sequence applied to the third green pixel G3 of FIG. 7, during the first horizontal period of its three horizontal periods 3H, the high grayscale voltage, which is the final data voltage for the first green pixel G1, will be precharged to the third green pixel G3. During the second horizontal period of three horizontal periods 3H, the low grayscale voltage, which is the final data voltage for the second blue pixel B2, will be precharged to the third green pixel G3. During the third horizontal period of three horizontal periods 3H, the high grayscale voltage, which is the final data voltage for the third green pixel G3, is outputted to the third green pixel G3. In this case, the low grayscale voltage from the dark Blue column is precharged onto the third green pixel G3 during the second horizontal period so that the desired precharging effect of precharging to a level close to the final high grayscale of G3 may disappear. As a result, the third green pixel G3 may display a relatively dark green color due to the undesired pre-charge given to it due to the dark final state of B2.

As for the fourth green pixel G4, it will not suffer a similar fate because during the first horizontal period of three horizontal periods 3H, the high grayscale voltage, which is the data voltage for the second green pixel G2, is precharged onto the fourth green pixel G4. During the second horizontal period of three horizontal periods 3H, the high grayscale voltage, which is the data voltage for the third red pixel R3, is precharged onto the fourth green pixel G4. During the third horizontal period of three horizontal periods 3H, the high grayscale voltage, which is the final data voltage for the fourth green pixel G4, is outputted to the fourth green pixel G4. In this case, the high grayscale voltages are precharged to the fourth green pixel G4 during the first and second horizontal periods so that the desired precharging effect is maximized. As a result, the fourth green pixel G4 displays relatively bright green color while the third green pixel G3 which may be desired to have same luminance tends to display as perceptibly darker green.

Therefore, the horizontal streak line (e.g., a dark shadow along the row of G3) may be displayed due to a difference of the pre-charging sequences applied respectively to the third and fourth green pixels G3 and G4 so that display artifacts may be generated.

In FIG. 7, the pixel columns represent red, green and blue. However, an example embodiment of the present disclosure is not limited thereto. For example, the pixel columns may be configured to represent yellow, cyan and magenta or four or more primary colors (e.g., RGBW) may be used in place of the exemplary RGB trio.

Figure 8A:
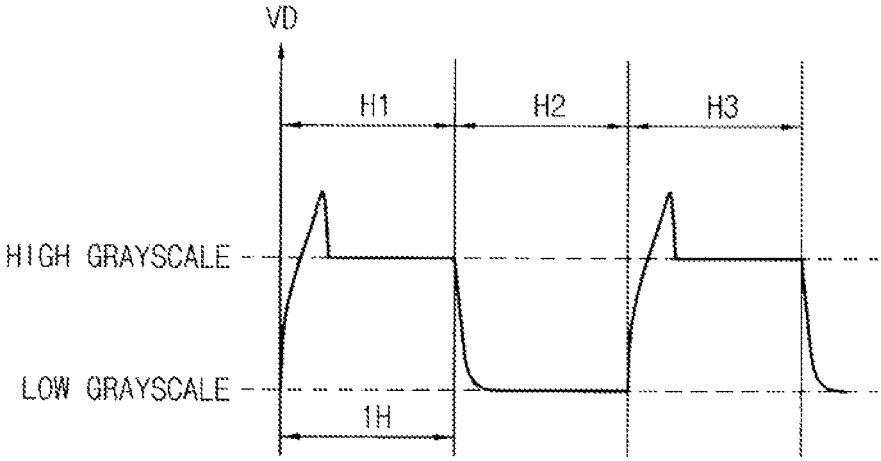
FIG. 8A is a timing diagram illustrating a data voltage waveform over 3 Horizontal scan periods (H1-H3) where the data voltage waveform includes an over-shoot waveform portion.
Figure 8B:
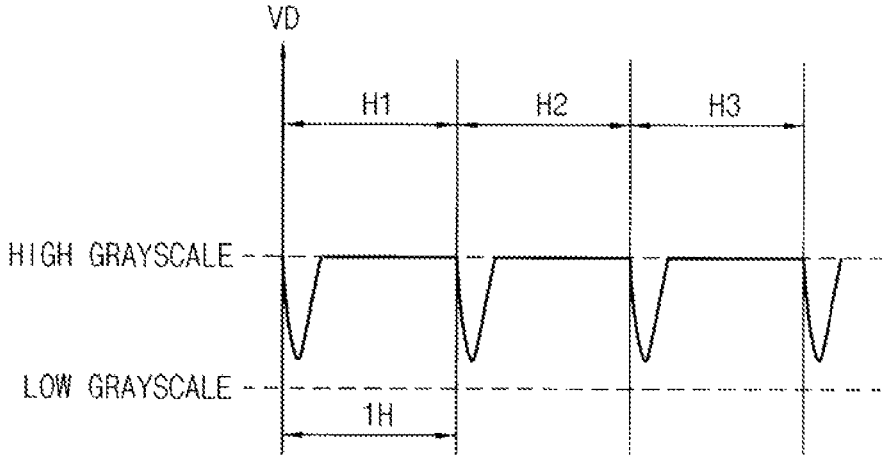
FIG. 8B is a timing diagram illustrating a data voltage waveform over 3 Horizontal scan periods (H1-H3) where the data voltage waveform includes an under-shoot waveform portion.

FIG. 8A is a timing diagram illustrating a data voltage over-shoot driving method that may be used to counter the above described problem. FIG. 8B is a timing diagram illustrating a data voltage under-shoot driving method that may be used to counter the above described problem.

Referring to FIGS. 7 and 8A or 8B, it is seen that the applied data voltage waveform VD has at least two different levels during at least one of the horizontal periods (1H) in which the data voltage waveform VD is active. More specifically, the data voltage waveform VD includes the grayscale voltage pixel whose level corresponds to the digital data signal and the data voltage waveform VD includes a compensating voltage portion (e.g., overshoot) of a level different from the level of the grayscale voltage.

FIG. 8A is illustrative of an overshoot version of the data voltage waveform VD as used for the third green subpixel G3 of FIG. 7. During the first horizontal period H1 and the third horizontal period H3 of the three horizontal periods 3H in which VD is active, the data voltage waveform VD having a high grayscale voltage component is outputted. During the second horizontal period H2 of three horizontal periods 3H, the data voltage waveform VD having the low grayscale voltage component is outputted. In the first horizontal period H1, the data voltage VD includes an over-shoot voltage portion provided as a compensating signal before the data voltage VD is converged to the grayscale voltage having the high grayscale voltage. This is called as the over-shoot driving method. The low grayscale voltage which is being compensated against is precharged to the third green pixel G3 during the second horizontal period H2 so that the precharging effect of the high grayscale voltage (if it provided alone) disappears. As a result, the pre-charging level of the third green pixel G3 is relatively low (if the overshoot compensation is not also provided) and as a result, the third green pixel G3 may subsequently display a darker than desired green color. To increase the pre-charge level of pixels that are subject to such low pre-charging conditions, the compensating voltage having a level higher than the grayscale level is applied at the beginning of the corresponding first horizontal period H1 in FIG. 8A. The effective pre-charging of the pixel is thus increased so that the difference of pre-charging between differently situated pixels is decreased. Thus, pre-charge artifacts may be decreased.

FIG. 8B illustrates a compensating data voltage waveform VD that may be used for the fourth green pixel G4 of FIG. 7 where G4 is pre-charged with two brights instead of a bright and a dark as is the case with G3. During the first to third horizontal periods H1, H2 and H3, the data voltage waveform VD including components representing the bright high grayscale voltage is outputted. In the first horizontal period H1, the data voltage waveform VD includes an under-shoot voltage signal as the pre-charge compensating signal before the data voltage waveform VD is converged to the grayscale voltage having the high grayscale voltage. This is called the under-shoot compensating method. The high grayscale voltages are precharged to the fourth green pixel G4 during the first and second horizontal periods H1 and H2 so that the precharging effect is maximized. As a result, the pre-charging amount of the fourth green pixel G4 would be (if the under-shoots were not included) relatively high and the fourth green pixel G4 would display relatively bright green color. To decrease the effective pre-charging amount of the pixel having relatively high pre-chargings, the compensating voltage having a level lower than the grayscale level is applied at a beginning of each horizontal period including the first horizontal period H1. The pre-charging amount of the pixel (G4) having the relatively high pre-charging neighbors around it thus decreases so that the difference of the pre-charging amounts between pixels such as G3 and G4 is decreased. Thus, the display defects may be decreased.

In FIGS. 7 to 8B, the third and fourth green pixels G3 and G4 respectively represent a case of maximum difference in pre-charging amounts. However, an example embodiment of the present teachings is not limited thereto. In FIGS. 5 to 8B, the three-line precharging driving method is exampled. However, an example embodiment of the present teachings is not limited thereto. The over-shoot driving method and the under-shoot driving method according to the present disclosure may be applied to various pixel structures having lesser differences of pre-charging amount due to the precharging method used.

In the present example embodiment, the display defects may be decreased by applying the over-shoot driving method selectively to some or all data lines of the display panel 100 or applying the under-shoot driving method selectively to some or all data lines of the display panel 100. In addition, the display defects may be decreased by applying the over-shoot driving method to some data lines of the display panel 100 and applying the under-shoot driving method to some of other data lines of the display panel 100.

Figure 9A:
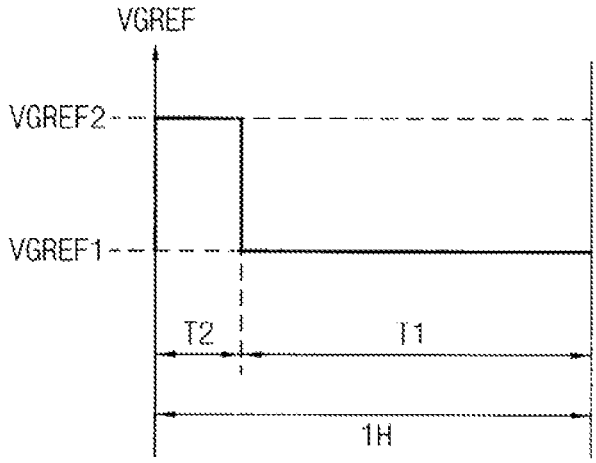
FIG. 9A is a timing diagram illustrating a generated gamma-correcting voltage waveform for use with the over-shoot compensating method.
Figure 9B:
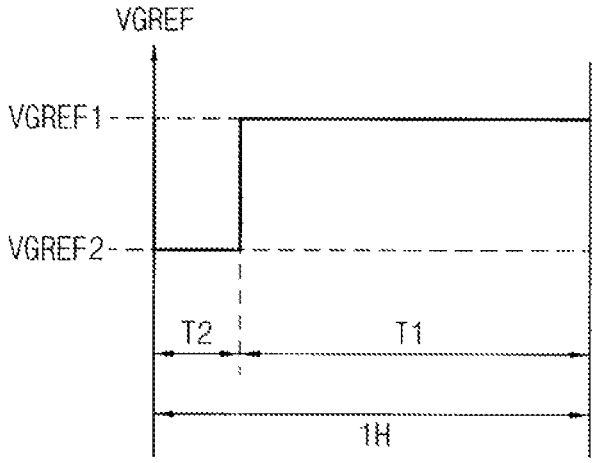
FIG. 9B is a timing diagram illustrating a generated gamma-correcting voltage waveform for use with the under-shoot compensating method.

FIG. 9A is a timing diagram illustrating a gamma-correcting voltage waveform that may be used for implementing the over-shoot driving method. FIG. 9B is a timing diagram illustrating a gamma-correcting voltage waveform that may be used for implementing the under-shoot driving method.

Referring to FIGS. 1, 7 to 9B, the gamma-correcting voltages VGREF having at least two levels corresponding to one data signal are generated during respective one horizontal period durations 1H (step S20). A waveform of the gamma-correcting voltages VGREF corresponding to one data signal may be a square wave or a pulse wave or a triangular wave.

FIG. 9A illustrates the gamma-correcting voltages waveform VGREF to be output for implementing the over-shoot outcome of FIG. 8A. In step S20, the gamma-correcting voltages VGREF including a reference gamma-correcting voltage level, VGREF1 and a pre-charge compensating voltage level VGREF2 is generated. The reference gamma-correcting voltage level\s VGREF1 represents a grayscale gamma-corrected voltage associated with a discrete level of the digital input DATA. The pre-charge compensating voltage level VGREF2 has a level higher than the level of the reference gamma-correcting voltage VGREF1, and represents an over-shoot voltage. The reference gamma-correcting voltage level VGREF1 is outputted during a first interval T1 of one horizontal period 1H, and the pre-charge compensating voltage level VGREF2 is outputted during a second interval T2 of the one horizontal period 1H. As shown in FIG. 9A, the second interval T2 for outputting the over-shoot voltage signal is prior to the first interval T1 for outputting the grayscale gamma-corrected drive voltage. The second interval T2 may be shorter than the first interval T1. For example, when one horizontal period 1H is 7 μs, the second interval T2 may be 2 μs and the first interval T1 may be 5 μs.

As discussed above referring to FIGS. 6 and 8A, the over-shoot driving method may be performed when the grayscale voltage having the low grayscale voltage is outputted during the second horizontal period H2 of three horizontal periods 3H.

FIG. 9B illustrates the gamma-correcting voltage waveform VGREF to be output according to the under-shoot method of FIG. 8B. In step S20, the gamma-correcting voltage waveform VGREF including the reference gamma-correcting voltage level VGREF1 and the pre-charge compensating, different voltage level VGREF2 is generated. The reference gamma-correcting voltages VGREF1 represents the grayscale gamma-correcting voltage. The pre-charge compensating voltage signal VGREF2 has a level lower than the level of the reference gamma-correcting voltage level VGREF1, and represents the under-shoot voltage signal. The reference gamma-correcting voltage level VGREF1 is outputted during a first interval T1 of the one horizontal period 1H, and the pre-charge compensating voltage level VGREF2 is outputted during a second interval T2 of one horizontal period 1H. As shown in FIG. 9B, the second interval T2 for outputting the over-shoot voltage signal is prior to the first interval T1 for outputting the grayscale gamma-corrected voltage level. The second interval T2 may be shorter than the first interval T1. For example, when one horizontal period 1H is 7 μs, the second interval T2 may be 2 μs and the first interval T1 may be 5 μs.

As discussed above referring to FIGS. 6 and 8B, the under-shoot driving method may be performed when the grayscale voltage having the high grayscale voltage is outputted during the first and second horizontal periods H1 and H2 of three horizontal periods 3H.

In the example embodiments shown by FIGS. 8A, 8B, 9A and 9B, the data voltage waveform VD and the gamma-corrected voltage waveform VGREF are supposed to have positive polarities (+). The levels of the data voltage signal VD and the gamma-correcting voltage signal VGREF are relative with respect to the common voltage. When the data voltage waveform VD and the gamma-correcting signal VGREF have negative polarities (−), the relationship between the levels of the reference gamma-correcting voltages VGREF1 and the compensating voltages VGREF2 may be inverted.

Thus according to the present teachings, a large difference of pre-charging amounts between two differently situated pixels (e.g., G3 and G4) that are disposed adjacent to each other may be compensated for so that a perceptible spot or horizontal streak line due to artifact luminance differences may be prevented. Therefore, display quality of a display panel may be improved.

The foregoing is illustrative of the present teachings and is not to be construed as limiting thereof. Although a few example embodiments in accordance with the present disclosure have been described, those skilled in the art will readily appreciate from the foregoing that many modifications are possible in the example embodiments without materially departing from the novel teachings disclosed here. Accordingly, all such modifications are intended to be included within the scope of the present teachings. In the below claims, means-plus-function clauses are intended to cover the structures described herein as performing the recited function and not only structural equivalents thereof but also functionally equivalent structures. Therefore, it is to be understood that the foregoing is merely illustrative and is not to be construed as limiting the present teachings to the specific example embodiments disclosed, herein.

What is claimed is:

1. A method of driving a display panel having gate lines and data lines, where the display panel is structured for polarity inversion by way of column inversion applied to the data lines, the method comprising:

outputting a row-selecting gate signal that is active over at least three horizontal scan periods to one of the gate lines of the display panel such that charges applied by a same data line for a previous, at least two rows are summed as pre-charging amounts of charge applied to a corresponding current pixel electrode of a currently-to-be set row;

generating a gamma-corrected analog voltage corresponding to a received digital data signal, where the data signal represents a desired luminance output for the pixel of the current pixel electrode of the currently-to-be set row;

generating a pre-charge compensating signal that represents compensation for excess dimness or excess brightness resulting from the summed pre-charging amounts of charge due to columnar transition between relatively bright grayscale values in one column and relatively dark grayscale values in and adjacent column; and outputting to a corresponding one of the data lines, an analog data voltage waveform having a grayscale voltage level portion corresponding to the gamma-corrected analog voltage and having a compensating voltage signal portion corresponding to the compensation represented by the generated pre-charge compensating signal, the compensating voltage signal portion having a magnitude different from that of the grayscale voltage level portion, where both the grayscale voltage level portion and the compensating voltage signal portion appear during one horizontal scan period, and where the display panel has a multi-pixels structure in which each data line is alternately connected when traversing along the data line, to first and second subpixel columns disposed adjacent to each other.

2. The method of claim 1, wherein the display panel comprises a plurality of repeated pixel units, where a first of the pixel units comprises:

a first subpixel connected to a first gate line and a first data line;

a second subpixel connected to the first gate line and a second data line adjacent to the first data line;

a third subpixel connected to the first gate line and a third data line adjacent to the second data line where a second of the pixel units is disposed immediately below the first pixel unit and comprises:

a fourth subpixel connected to a second gate line and a fourth data line;

a fifth subpixel connected to the second gate line and the first data line;

a sixth subpixel connected to the second gate line and the second data line;

where a third of the pixel units is disposed immediately below the second pixel unit and comprises:

a seventh subpixel connected to a third gate line and the first data line;

an eight subpixel connected to the third gate line and the second data line;

a ninth subpixel connected to the third gate line and the third data line; and wherein the eighth subpixel is pre-charged with a final charging voltage of the second subpixel and with a final charging voltage of the fifth subpixel.

3. The method of claim 2, wherein an analog voltage generator generates both the gamma-correcting voltage level portion and the pre-charge compensating voltage signal portion during one horizontal scan period (1H) to thereby define the gamma-correcting voltage waveform.

4. The method of claim 3, wherein the gamma-correcting voltage waveform generated by the analog voltage generator comprises a reference gamma-correcting voltage level corresponding to a grayscale luminance indicated by the received digital data signal and a pre-charge compensating voltage level whose magnitude is different from that of the reference gamma-correcting voltage level.

5. The method of claim 4, wherein the pre-charge compensating voltage level is output during a second interval that is prior to a first interval wherein the gamma-correcting voltage level is output and where the first and second intervals are in one horizontal scan period.

6. The method of claim 5, wherein the second interval is shorter than the first interval.

7. The method of claim 5, wherein the pre-charge compensating voltage level is higher than the gamma-correcting voltage level.

8. The method of claim 7 wherein:

the row-selecting gate signal is active over a plurality of at least three horizontal scan periods when applied to the eighth subpixel, the final data voltage of the second subpixel is used to precharge the eighth subpixel during a first of said at least three horizontal scan periods, the final data voltage of the sixth subpixel is used to precharge the eighth subpixel during a second of said at least three horizontal scan periods, the final data voltage for the eighth subpixel is outputted during a third of said at least three horizontal scan periods to finally charge the eighth subpixel, and the final data voltage of the sixth subpixel has a grayscale level substantially smaller than that of the final data voltage of the eighth subpixel.

9. A display apparatus comprising:

a display panel having a pixel structure in which each of successive data lines is alternately connected on a row-by-row basis among successive rows of subpixels, to first and second subpixel columns adjacent to each other;

a timing controller structured to generate a first control signal, a second control signal and a data signal;

a gate driver structured to output successive gate signals to gate lines of said rows of subpixels based on the first control signal;

a gamma-correcting voltage waveforms generator structured to generate waveforms having respective gamma-correcting voltages corresponding to predetermined discrete values of a received digital data image signal; and a data driver coupled to the gamma-correcting voltage waveforms generator and structured to output data voltage signals each comprising a grayscale voltage level corresponding to a gamma-correcting voltage produced by the gamma-correcting voltage waveforms generator for a currently-to-be set luminance of a corresponding subpixel, the output data voltage signals each further comprising a pre-charge compensating voltage signal having a level different from that level of the grayscale voltage level, where the pre-charge compensating voltage signal is configured to compensate for excess dimness or excess brightness resulting from a summed group of pre-charging amounts of charge provided over two or more horizontal periods preceding the one where a currently-to-be set luminance is set and the excess dimness or excess brightness is due to columnar transition between relatively bright grayscale values in one column and relatively dark grayscale values in and adjacent column; and where the grayscale voltage level and the pre-charge compensating voltage signal are output during one horizontal period of the display panel.

10. The display apparatus of claim 9, wherein the display panel comprises a plurality of pixel units, and each of the pixel units comprises:

a first subpixel connected to a respective first gate line of the pixel unit and a respective first data line of the pixel unit;

a second subpixel connected to the respective first gate line and to a respective second data line of the pixel unit adjacent to the respective first data line;

a third subpixel connected to the respective first gate line and to a respective third data line of the pixel unit.

11. The display apparatus of claim 10, wherein the display panel comprises a first pixel unit, a second pixel unit and a third pixel unit disposed vertically adjacent one to the next in said order, the gate signal representing ON is continuously outputted to the second subpixel of the third pixel unit during three horizontal periods, the data voltage for the second subpixel of the first pixel unit is used to precharge the third subpixel of the third pixel unit during the first horizontal period, the data voltage for the third subpixel of the second pixel unit is used to precharge the second subpixel of the third pixel unit during the second horizontal period, and the data voltage for the second subpixel of the third pixel unit is outputted to the second subpixel of the third pixel unit during the third horizontal period.

12. The display apparatus of claim 11, wherein the gamma-correcting voltage has at least two levels during one horizontal period.

13. The display apparatus of claim 12, wherein the output data voltage signal of the data driver comprises a reference gamma-correcting voltage having a first level output during a first interval of one horizontal period and a pre-charge compensating voltage having a second level different from the first level output during a second interval of one horizontal period.

14. The display apparatus of claim 13, wherein the second interval is prior to the first interval in one horizontal period.

15. The display apparatus of claim 14, wherein the grayscale voltage of the data voltage for the second subpixel of the first pixel unit has a low grayscale level, the second level is higher than the first level, and the data voltage comprises the grayscale voltage and the compensating voltage having a level higher than that of the grayscale voltage.

16. The display apparatus of claim 14, wherein the grayscale voltages of the data voltage for the second subpixel of the first pixel unit and the data voltage for the second subpixel of the second pixel unit have a high grayscale level while the data voltage for the third subpixel of the second pixel unit has a substantially lower grayscale level.

* * * * *